United States Patent [19]

Bensussan et al.

[11] 4,229,657

[45] Oct. 21, 1980

[54] γ-RAY IRRADIATION HEAD FOR PANORAMIC IRRADIATION

[75] Inventors: André Bensussan; Guy Azam, both of Paris, France

[73] Assignee: CGR-MeV, Paris, France

[21] Appl. No.: 891,647

[22] Filed: Mar. 30, 1978

[30] Foreign Application Priority Data

Apr. 1, 1977 [FR] France ..... 77 09949

[51] Int. Cl.[2] ..... G21G 4/00

[52] U.S. Cl. ..... 250/493; 250/399; 250/405

[58] Field of Search ..... 250/493, 406, 399, 402, 250/405

[56] References Cited

U.S. PATENT DOCUMENTS

| | | | |
|---|---|---|---|
| 1,645,304 | 10/1927 | Slepian | 250/402 |
| 2,598,925 | 6/1952 | Linder | 250/493 |
| 3,062,960 | 11/1962 | Laser | 250/406 |
| 3,138,729 | 6/1964 | Henke | 250/402 |
| 3,857,039 | 12/1974 | Franke et al. | 250/406 |
| 3,894,239 | 7/1975 | Braun | 250/493 |
| 3,930,181 | 12/1975 | Pfeiffer | 250/396 ML |
| 4,007,375 | 2/1977 | Albert | 250/404 |
| 4,068,127 | 1/1978 | Goodenough | 250/406 |

*Primary Examiner*—Harold A. Dixon

*Attorney, Agent, or Firm*—Oblon, Fisher, Spivak, McClelland & Maier

[57] ABSTRACT

The invention relates to a γ-ray irradiation head for panoramic irradiation comprising a tungsten target revolving about an axis, and means for deflecting electrons around the same axis for producing photons in several directions either successively or simultaneously. When the beam of electrons is deflected in its entirety and when the impact zone moves on the target about the axis, the axis of the radiation lobe moves in the same way and permits irradiation according to a variable azimuth.

6 Claims, 6 Drawing Figures

γ-RAY IRRADIATION HEAD FOR PANORAMIC IRRADIATION

This invention relates to a γ-ray irradiation head for panoramic irradiation.

γ-rays are being increasingly used in certain industries, for example in metallurgy, for detecting faults in a machined part (by radiography) or for following the effects of a mechanical or thermal treatment. For X-raying thick objects, it is necessary to use high energy radiation. To this end, a beam of electrons accelerated under an energy of from 2 to 10 MeV in a vacuum tube strikes a metallic target, generally a tungsten pellet, and gives rise to a γ-radiation. The target is fixed in a block of copper and is cooled because, since the kinetic energy of most of the incident electrons is converted into heat, the target has to be able to withstand a considerable increase in temperature. The penetration power of the rays is greater, the higher the anodic voltage. The emission lobe of the radiation is narrower (directional radiation), the greater the energy content of the incident electrons. To irradiate at a large solid angle, it is possible to use the retro-diffused decelerating radiation. In this case, the radiation is dispersed but is only significant for low energy levels. Thus, experience has shown that, with conventional irradiation heads—the target being a tungsten pellet arranged in the axis of the beam of accelerated electrons—the emission of high-energy γ-rays is not compatible with dispersion of the radiation and it is therefore not possible simultaneously to irradiate several objects distributed around the target, or a hollow object, with high-energy radiation.

The present invention has for its object an irradiation head for panoramic irradiation, the rays emitted including a solid angle. To this end, the target used is a body revolving about the axis of the accelerated beam and means for deflecting the accelerated electrons are provided to ensure that that these electrons impinge upon the target either by scanning a narrow beam of electrons on the target or by impinging upon a large part of the target.

For a better understanding of the invention and to show how the same may be carried into effect, reference will be made to the following description and the attached drawings among which:

Figure 1:
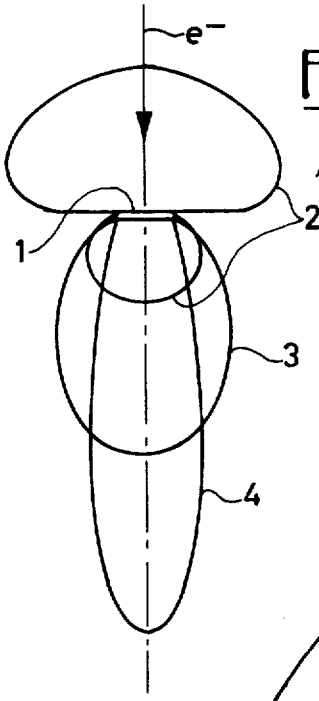
FIG. 1 PRIOR ART
FIG. 1 shows the emission lobes corresponding to a conventional target (PRIOR ART)

The emission of high-energy γ-rays by means of a linear accelerator is obtained in the following manner: electrons are supplied by a thermoemissive cathode under an electrical field of from 30 to 50 Kv for example. These electrons are then accelerated in an accelerating section of the UHF type (a few thousand Mhz) by high-power pulses (a few megawatts) lasting several microseconds and striking the target which is generally a tungsten pellet. When an electron strikes the target, it is suddenly decelerated, giving rise to the emission of an electromagnetic radiation. In addition, electrons of the beam cause the ionization of certain atoms of the target and the migration of the electrons on the various layers of the atoms cause photons to be emitted. The intensity of the radiation depends upon the heating voltage of the cathode and the directivity of the radiation emitted depends upon the energy of the γ-rays emitted. In FIG. 1 which corresponds to the prior art, a tungsten target 1, under the impact of the beam of electrons, emits in a radiation lobe 2 with electrons having an energy of 2 MeV, in a radiation lobe 3 with electrons having an energy of 5 MeV and in a radiation lobe 4 with electrons having an energy of 10 MeV; the narrowest lobe 4 corresponds to a more directional radiation.

Figure 2:
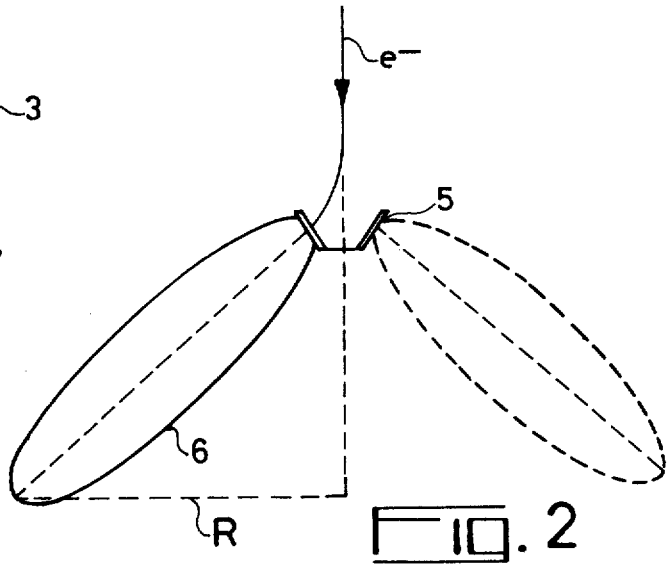
FIGS. 2 and 3 show the emission lobes corresponding to targets according to the invention.

In FIG. 2, which corresponds to an embodiment of the invention, a tungsten target 5 frustoconical in shape emits a radiation lobe 6 under the impact of the deflected beam of electrons $e^-$. The deflection system for the beam of electrons is such that the impact zone describes on the target a circle centered on the axis of the non-deflected beam and the end of the radiation lobe also describes a circle of radius R in the plane orthogonal to the axis of the accelerated beam. Another position of the radiation lobe is shown in dotted lines in the drawing.

Figure 3:
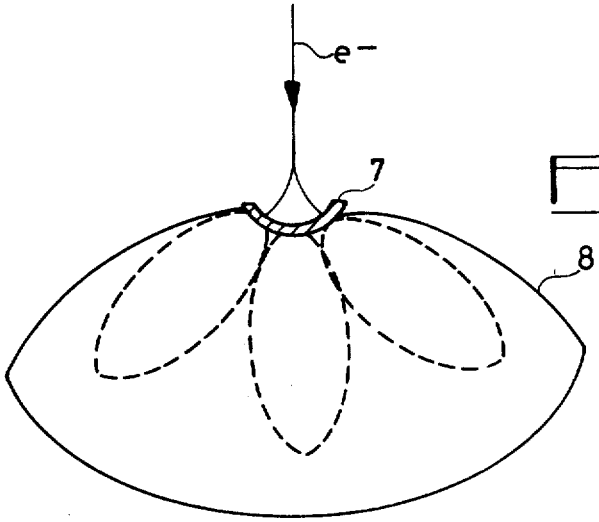

In FIG. 3, which corresponds to a second embodiment of the invention, the accelerated beam of electrons $e^-$ is rendered divergent by means of a deflection device for the electrons and strikes the spherical target 7 over a large part of its surface. The γ-radiation 8 emitted includes a large space and permits the irradiation of objects situated inside the included zone.

Figure 4:
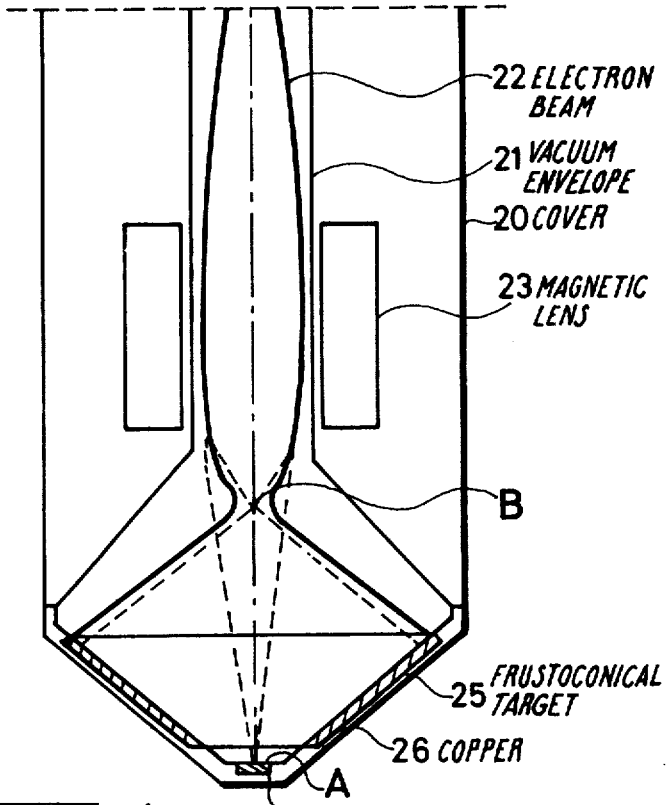
FIG. 4 shows a first embodiment of the irradiation head according to the invention, the panoramic irradiation being simultaneously effected in all the azimuths.

FIG. 4 is a section through a γ-ray irradiation head according to one embodiment of the invention.

The cover 20 of the irradiation head contains a vacuum envelope 21 in which travels a beam 22 of accelerated electrons. This beam of accelerated electrons diverges slightly in front of the focussing magnetic lens 23. This lens is formed by exciting coils which, in operation, are traversed by a current such that the magnetic field created causes the electrons to converge. In a conventional system, the magnetic field is such that the electrons converge at A, a tungsten target 24 being arranged at that point. In addition to the target 24, the system according to the invention comprises a target 25 frustoconical in shape, revolving about the axis of the accelerated beam. The targets are fixed in a block 26 of copper. The target 25 is of small dimensions because the diameter of the irradiation head according to the invention does not exceed a few centimeters.

If the current in the exciting coils increases, the magnetic field also increases and the focussing spot of the beam of electrons moves along the axis up to the point B for example. After this point, therefore, the beam diverges and includes a solid angle which is greater, the stronger the current. The electrons strike the revolving target 25 over part of its surface. From each point of this target is emitted a radiation lobe γ. Globally, the lobe of photons revolves and permits the irradiation of objects surrounding the head simultaneously over their entire lateral wall. In a mode of operation such as this, part of the beam of electrons also strikes the direct target situated in the axis of the beam of electrons, although the proportion of radiation which strikes this direct target is low (in the ratio of the surfaces. )

The revolving target 25, like the direct target 24, may be positioned immediately behind the accelerating section of the accelerator or at the end of a sliding tube.

Figure 5:
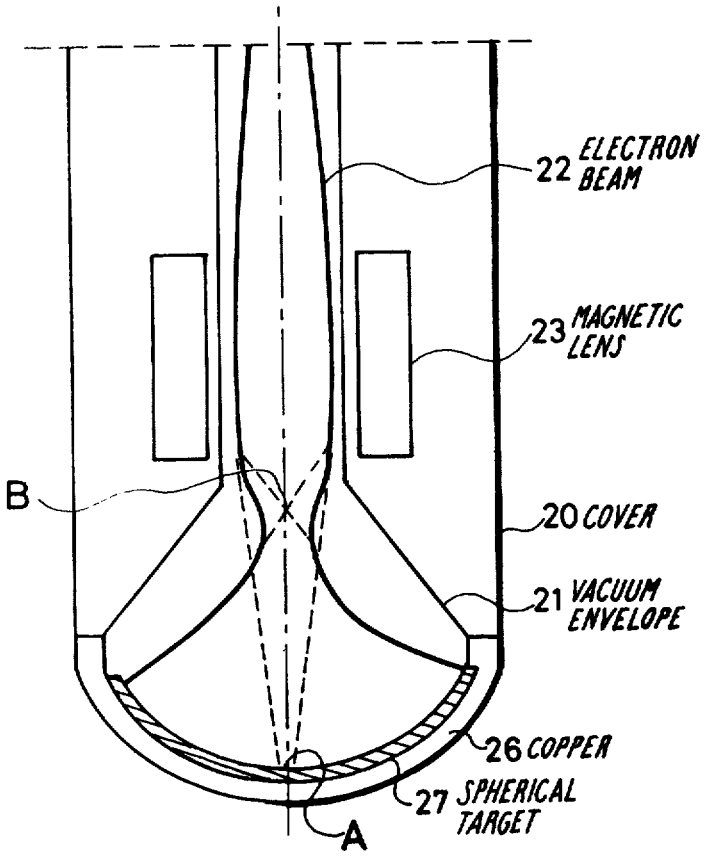
FIG. 5 shows a second embodiment of the irradiation head according to the invention, irradiation being simultaneously effected in all the azimuths.

FIG. 5 shows another embodiment of a γ-ray irradiation head according to the invention. The same elements as in FIG. 4 have been denoted by the same reference numerals. In FIG. 5, the end of the irradiation head is in the form of a spherical cap like the target 27 which follows the shape of the inner wall.

In these two embodiments of the irradiation head according to the invention, irradiation takes place in a solid angle. The electrons are therefore dispersed on a target of large surface area by comparison with the surface area of conventional targets. Accordingly, to obtain a sufficiently contrasted image of the object to be analysed, it is necessary to irradiate this surface for a sufficiently long period for each of the points to have received the necessary quantity of photons.

Figure 6:
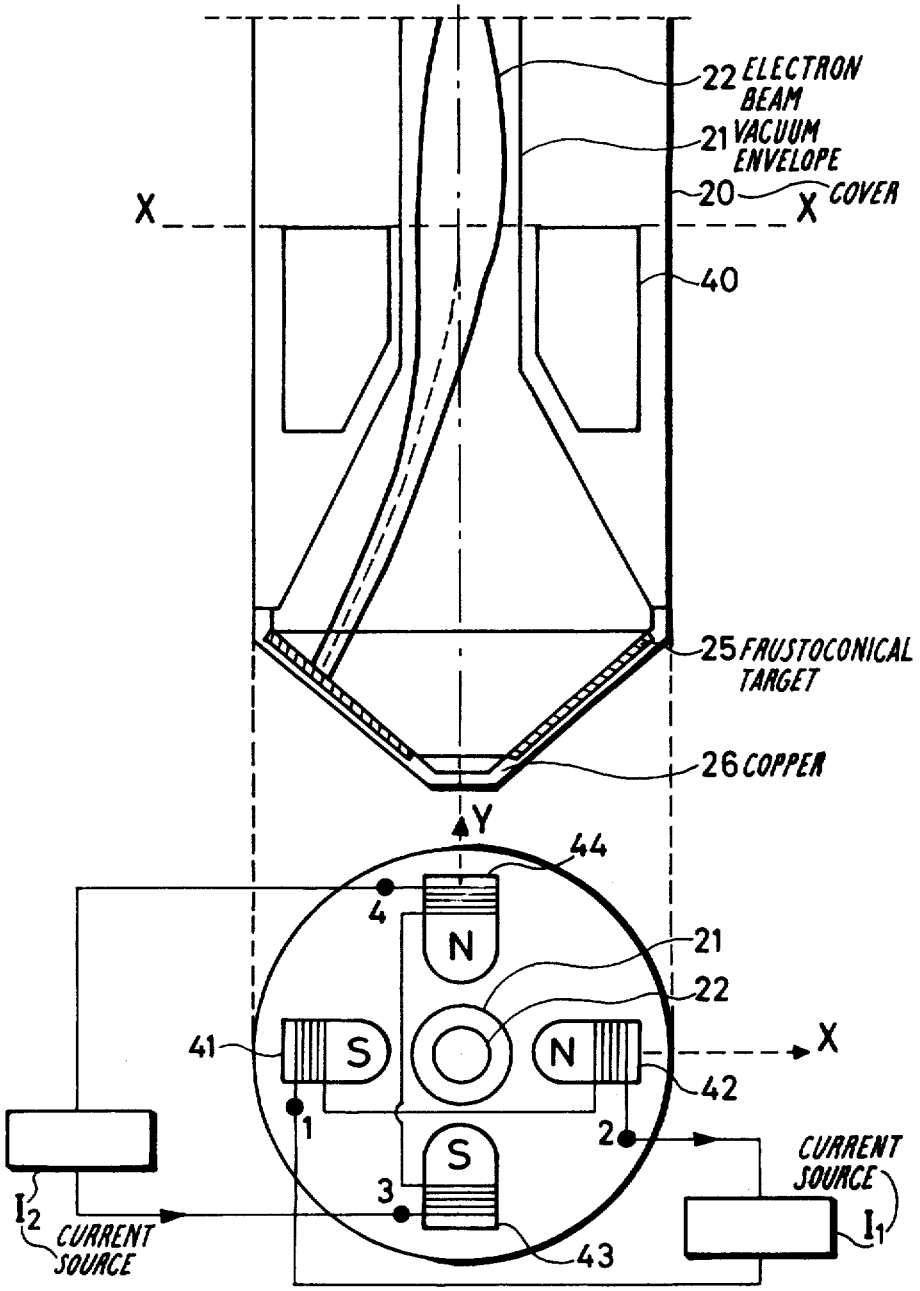
FIG. 6 shows a third embodiment of the irradiation head according to the invention, the panoramic irradiation being effected by scanning of the target by the beam of accelerated electrons.

The irradiation head shown in FIG. 6 enables the entire beam of electrons to be deflected so that it strikes the target on an impact zone of small surface area. This impact zone is capable of being displaced on the target either in steps, in which case images of each of the points of the object to be analysed are obtained, or continuously, in which case the impact zone scans the target at a rhythm determined by the frequencies of the currents applied to the deflection coils.

In this drawing, the same elements as in the preceding ones have been denoted by the same reference numerals. In particular, the cover of the irradiation head 20 comprises a vacuum envelope 21 in which travels a beam 22 of accelerated electrons. The tungsten target 25 is frustoconical in shape. In this embodiment, the accelerated beam of electrons is deflected in its entirety, relative to the axis of the incident beam of accelerated electrons, and is made to rotate about that axis by means of a quadripolar magnetic device 40 of which the wiring diagram is shown in the part of the drawing showing a section along X through the irradiation head shown in the first part of the drawing. A current $I_1$ delivered by a current source flows through the windings of the poles 41 and 42 between the points 1 and 2 whilst a current $I_2$ delivered by the current source flows through the windings of the poles 43 and 44 between the points 3 and 4. The currents $I_1$ and $I_2$ are sinusoidal currents of pulsation $\omega$ phase-shifted by $\pi/2$.

The poles 1 and 2 create an instantaneous induction $B_x = Bo_x \sin \omega t$ along the axis X, $Bo_x$ being the maximum amplitude of the induction along the axis X.

Under the effect of this induction, the beam of accelerated electrons undergoes a deflection x along the axis X: $x = k\ Bo_x \sin \omega t$.

The poles 3 and 4 create an instantaneous induction $By = Bo_y \cos \omega t$ along the axis Y, $Bo_y$ being the maximum amplitude of the induction along the axis Y. Under the effect of this induction, the beam of accelerated electrons undergoes a deflection y along the axis Y of amplitude $y = k\ Bo_y \cos \omega t$. k is a constant which depends upon the distance travelled by the beam after having left the interaction space of the magnetic fields up to the target. The centre of the impact zone of the beam on the target, in a plane orthogonal to the axis of the irradiation head, describes a circle if the components of the induction along X and Y, $Bo_x$ and $Bo_y$, are equal or an ellipse if these components are different.

Accordingly, alternating currents of the type in question make it possible for example for the impact zone to describe a circle on the tungsten target, in which case the axis of the radiation lobe generates a frustum. With the same arrangement, if the currents $I_1$ and $I_2$ are adjusted to constant values, the beam of electrons is deflected from its path along the axes X and Y of constant values and remains fixed providing the currents $I_1$ and $I_2$ do not change value. An arrangement such as this enables structures in which it is possible to introduce the irradiation head to be examined point by point. By increasing the current flowing through the exciting coils, the beam of electrons is deflected through a larger angle and, it is possible, by selecting the shape of the poles and the shape of the vacuum envelope in such a way that the beam of electrons is not blocked by the walls of the envelope and does in fact strike the target, to obtain a γ-radiation lobe of which the axis is perpendicular to the axis of the incident beam of accelerated electrons, in which case, irradiation is radial relative to the axis of revolution of the irradiation head.

A panoramic irradiation, by scanning of the revolving target, is obtained with an arrangement such as this, the beam of electrons rotating about the axis of the irradiation head.

The invention is not limited to the embodiments of the irradiation head described and illustrated.

In particular, the targets described above were in the form of a frustum or spherical cap. These forms are by no means the only forms and it is possible to use a target in the form of a revolving cylinder. However, if the radiation emitted is to be homogeneous for different azimuths, it is important to ensure that the directions of incidence of the electrons on the corresponding zones of the target are not too different. The forms illustrated in the drawings enable the target to be bombarded in quasi-normal directions, irrespective of the azimuth.

In addition, in the description of the scanning mode, the currents passing through the two electromagnets were described as having the same pulsation. If the currents have different pulsations, it is still possible to scan the target although, in that case, the figure described is a Lissajous figure.

Finally, the deflection devices described are the simplest to use for obtaining the required results (deflection of the entire beam and scanning or beam rendered divergent to include a solid angle). Deflection devices using several pairs of poles may be used to rotate the beam of charged particles about the axis of the irradiation head. For example, to obtain periodic scanning of the revolving target, it is possible to use three pairs of poles respectively fed by currents phase-shifted by $\pi/3$ or, generally, n pairs of poles fed by currents phase-shifted by $\pi/n$, creating a rotating magnetic field.

This irradiation head may be used in a portable accelerator for borings in petroleum exploration, for medical radiography or in metallurgy for examining plates, joints or hollow parts.

What we claim is:

1. A γ-ray irradiation head for panoramic irradiation using a beam of charged and accelerated particles, said irradiation head having a longitudinal axis along which said particles propagate in the absence of deflection, said head comprising an electromagnetic deflection device for deflecting said charged particles and a target having an active surface revolving about the axis of the irradiation head, said deflection device separating the paths of the particles from said axis in such a way that the particles impinge upon the revolving target; said deflection device comprising a multipolar magnetic device, and a feed circuit, to deflect the beam of charged particles in its entirety and to make it converge on said target in a small impinging zone, the magnetic device being fed by said feed circuit such that the magnetic field rotates about the axis of the irradiation head, the mean deflection of the deflected beam being variable and the impinging zone moving correlatively on said target; said multipolar magnetic device being a quadripolar magnetic device, and the windings of pole pieces of said quadripolar magnetic device being fed in pairs and in series by two sinusoidal currents in quadrature delivered by the feed circuit for periodic scanning of the target by the beam of particles.

2. A γ-ray irradiation head for panoramic irradiation as claimed in claim 1, wherein said target is frustoconical shaped and has the same axis as the irradiation head, the small base surface of the cone forming the end of the irradiation head.

3. A γ-ray irradiation head for panoramic irradiation using a beam of charged and accelerated particles, said irradiation head having a longitudinal axis along which said particles propagate in the absence of deflection, said head comprising an electromagnetic deflection device for deflecting said charged particles and a target having an active surface revolving about the axis of the irradiation head, said deflection device separating the paths of the particles from said axis in such a way that the particles impinge upon the revolving target; said deflection device being comprised of a magnetic focussing device and a feed circuit connected to said magnetic focussing device to cause the beam of particles to converge on the axis of the irradiation head in front of the target in such a way that said target receives a divergent beam of particles.

4. A γ-ray irradiation head for panoramic irradiation as claimed in claim 3, wherein said target is frustoconical shaped and has the same axis as the irradiation head, the small base surface of the cone forming the end of the irradiation head.

5. A γ-ray irradiation head for panoramic irradiation as claimed in claim 4, wherein a direct target is arranged in the axis of the irradiation head on the small base surface of the cone, said deflection device for the charged particles not being in operation for direct irradiation.

6. A γ-ray irradiation head as claimed in claim 3, wherein said target is in the form of a spherical cap centered on said axis.

* * * * *